US006431063B2

(12) United States Patent
Dölfel et al.

(10) Patent No.: US 6,431,063 B2
(45) Date of Patent: Aug. 13, 2002

(54) EMBOSSING PRESS FOR PRODUCING EMBOSSED SEAMS

(75) Inventors: Rainer Dölfel; Stephan Frank, both of Porta Westfalica; Joachim Freiheit, Hille; Hans Olthaus, Minden, all of (DE)

(73) Assignee: Melitta Haushaltsprodukte GmbH & Co., KG, Minden (DE)

( * ) Notice: Subject to any disclaimer, the term of this patent is extended or adjusted under 35 U.S.C. 154(b) by 0 days.

(21) Appl. No.: 09/738,636

(22) Filed: Dec. 18, 2000

(30) Foreign Application Priority Data

Dec. 22, 1999 (DE) ..... 199 61 961

(51) Int. Cl.[7] ..... B31F 1/07
(52) U.S. Cl. ..... 101/23; 101/28
(58) Field of Search ..... 101/23, 28, 25; 156/209

(56) References Cited

U.S. PATENT DOCUMENTS 3,418,925 A * 12/1968 Wiggins ..... 101/23
5,158,521 A * 10/1992 Singh ..... 493/354

FOREIGN PATENT DOCUMENTS

DE 3312484 A1 * 10/1983
EP 62216 A2 * 10/1982

* cited by examiner

*Primary Examiner*—Daniel J. Colilla
(74) *Attorney, Agent, or Firm*—Venable; Catherine M. Voorhees

(57) ABSTRACT

The subject matter of the invention is an embossing press, including an embossing roller and a counter cylinder, for producing embossed seams by joining at least two paper layers or fleece layers, arranged one above the other and conveyed in a straight line. For this, the embossed seams extend at a slant or at a right angle relative to the conveying direction of the paper layers or fleece layers. The embossing roller is provided with at least two rows of embossing teeth, arranged at a distance to each other, and the counter cylinder is designed as fluted roller, at least in the area effective for the embossing operation.

5 Claims, 3 Drawing Sheets

EMBOSSING PRESS FOR PRODUCING EMBOSSED SEAMS

CROSS-REFERENCE TO RELATED APPLICATION

This application claims the priority of German Patent Application Serial No. 199 61 961. 1, filed on Dec. 22, 1999, the subject matter of which is incorporated herein by reference.

BACKGROUND OF THE INVENTION

The present invention relates to an embossing press, consisting of an embossing roller and a counter cylinder, for producing embossed seams designed to join at least two paper layers or nonwoven layers, arranged one above the other and conveyed in a straight line, wherein the embossed seams extend at a slant or at a right angle to the conveying direction for the paper layers or nonwoven layers.

Embossing presses of the generic type for producing embossed seams are known per se and are used in particular for the production of filter paper inserts.

Producing embossed seams with an embossing roller and a counter cylinder basically offers the advantage of high production speeds since the embossed seams can be generated during a continuous run.

So far, embossing presses of the known type could be utilized only for producing one embossed seam per machine use.

It is an object of the present invention to create a generic-type embossing press with expanded utilization option.

SUMMARY OF THE INVENTION

This object is solved according to the invention in that the embossing roller is designed to have at least two rows of embossing teeth, arranged at a distance to each other, and that the counter cylinder is designed as a fluted roller, at least in the region affected by the embossing operation.

This object is furthermore solved according to the invention in that the embossing roller is provided with a row of embossing teeth, for which the total width corresponds at least to the total width of the embossed seams that can be produced during each embossing operation and that the counter cylinder is designed as fluted roller, at least in the region affected by the embossing operation. The ridge areas in the embossing region are interrupted by at least one groove that corresponds to the non-embossed separating zones desired between the individual embossed seams that can be produced.

The two proposed solutions generally share the advantage that multiple embossed seams can be produced during each run with these embossing presses, without requiring a reduction in the production speed.

With filter inserts, for example, protection against tearing in the seam region can be increased clearly, without raising the production costs, by producing a double seam or a multiple seam.

In addition, the particular advantage of the initially proposed solution is that the proportions of a double embossed seam or a multiple embossed seam always remain constant.

If the counter cylinder is designed completely as fluted roller, it is generally not necessary to synchronize the operation between the embossing roller and the counter cylinder.

The special advantage of the embossing press according to the second solution is that the proportions of the double embossed seam or the multiple embossed seam can be changed through a special adjustment of the two rollers, relative to each other. In the process, an extremely narrow width can be adjusted for the individual embossed seams. Owing to the fact that the embossing roller is provided with embossing teeth having a relatively wide tooth width, the possibility of individual embossing teeth breaking out is reduced.

A very special advantage of the embossing press according to the second solution is that with an embossing press of this type, it is also possible to produce simple embossed seams through a skillful overlapping of the embossing teeth on the one hand and the grooves on the other, so that an embossing press of this type can be used for all possible and conceivable applications.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF THE PREFERRED EMBODIMENTS

Figure 1:
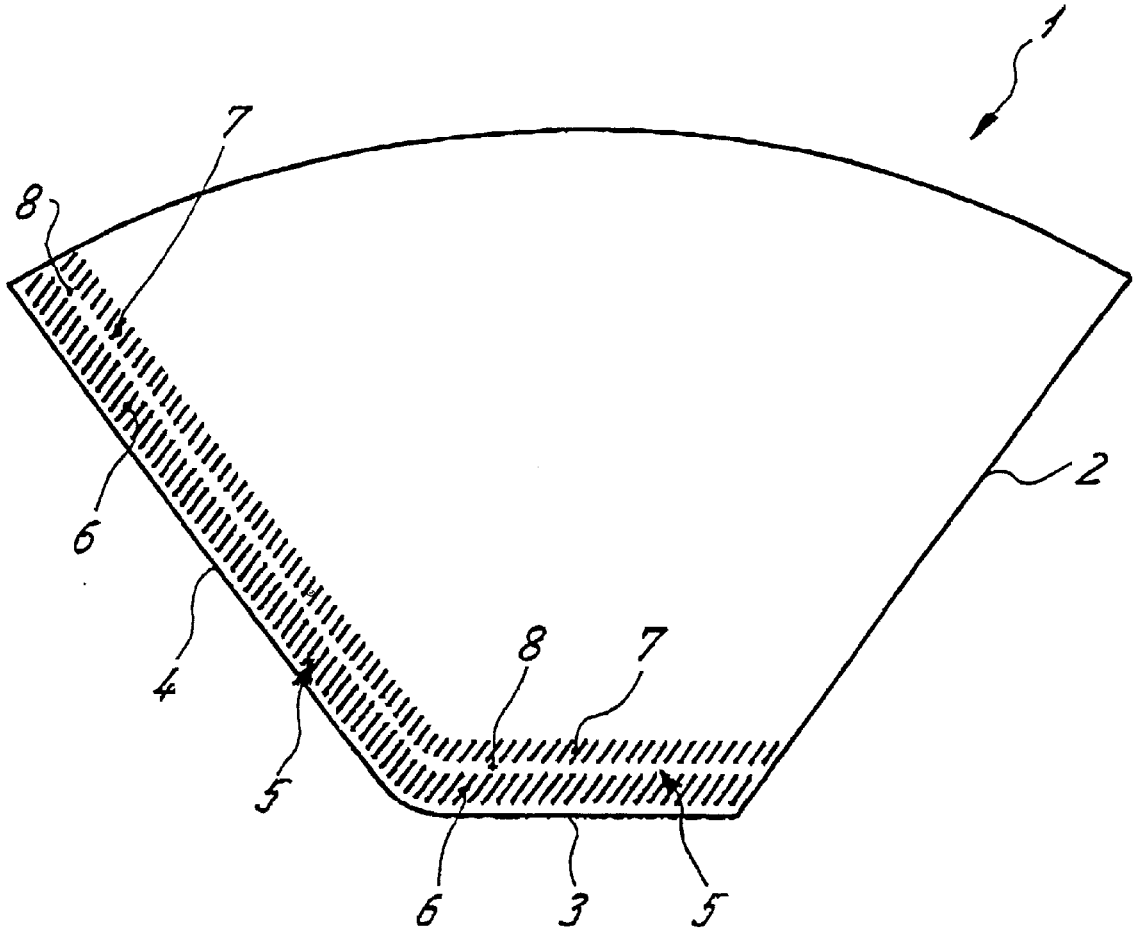
FIG. 1 Shows a view from above of a horizontally positioned filter paper insert with double embossed seams.

The reference number 1 in FIG. 1 denotes a filter paper insert, consisting in a manner known per se of two paper layers that are positioned one above the other. In the embodiment shown, these layers are folded one over the other around a joint folding edge 2, with the base having approximately the shape of a truncated pyramid.

This filter paper insert 1 is provided with embossed seams 5 in the region of its bottom edge 3 as well as in the region of the side edge 4, located opposite the folding edge 2, which seams join the two superimposed paper layers.

The embossed seams 5 respectively are double embossed seams, consisting of two individual embossed seams 6 and 7, which are respectively separated by a non-embossed zone 8.

Individual embossed seam 6 is respectively located in the outer edge region of filter paper insert 1, whereas the respectively other individual embossed seam 7 is arranged such that it is displaced toward the inside.

By designing the embossed seams 5 as double embossed seams, the seam region on the whole becomes very stable. Thus, a filter paper insert 1 with this type of design is extremely practical since it is nearly impossible for the seams to split apart when the insert is used as intended.

Filter paper inserts 1 are used in particular for producing aromatic extracts of coffee and tea. Filter paper inserts 1 of this type are inserted into a correspondingly formed filter container and are partially filled with an aroma carrier in the form of ground coffee or tea. Subsequently, heated brewing water is conveyed into the filter insert 1, either automatically in a coffee maker or tea maker or manually when a user pours heated water from a respective container into the filter insert 1.

With embossed seams, the splitting of the seam area for filter insert 1 as a result of stress caused by weight or stress due to moisture penetration of the filter paper insert 1 does not have to be feared.

Differing from the exemplary embodiment shown, the filter paper insert 1 can also be provided with an embossed seam in place of folded edge 2 if two separate filter paper layers are placed one on top of the other and are joined with the respective double embossed seams.

Filter paper inserts 1 of the type as shown in various embodiments in FIGS. 2–7 are produced in a production facility in the area of an embossing press 9 by joining paper layers that are arranged one above the other.

Figure 2:
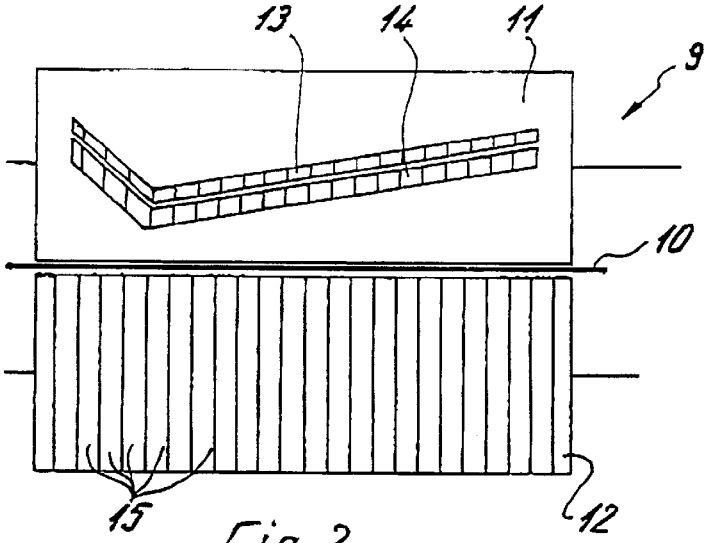
FIG. 2 Shows a schematic view of an embossing press, used to produce double embossed seams for joining at least two paper layers or nonwoven layers.
Figure 4:
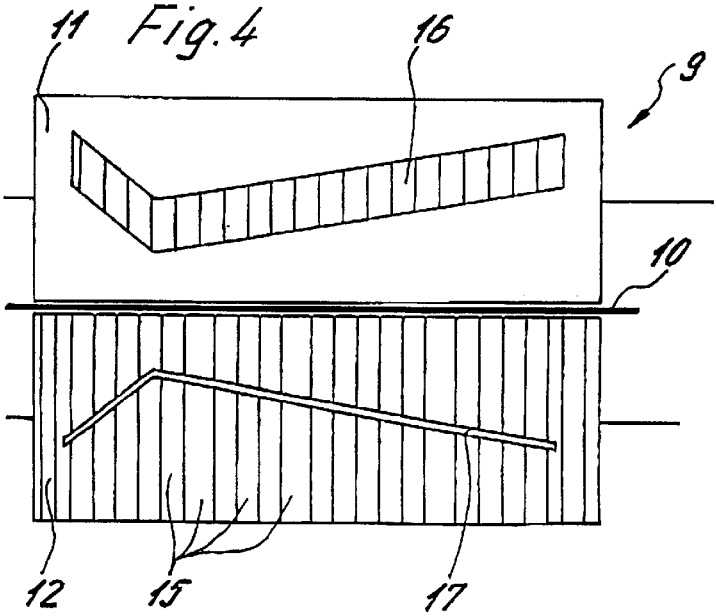
FIG. 4 Shows a view of an embossing press according to another exemplary embodiment of the invention, which view corresponds to FIG. 2.
Figure 6:
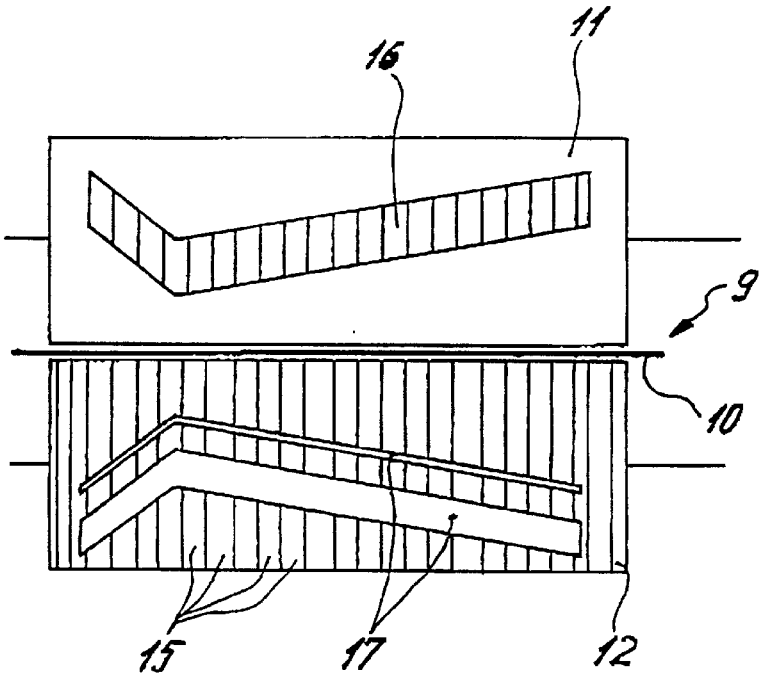
FIG. 6 Shows an embossing press according to another exemplary embodiment, in a view corresponding to one of the FIG. 2 or 4.

In FIGS. 2, 4 and 6, the paper layers arranged one above the other are respectively given the reference number 10. In the region of embossing press 9, these superimposed paper layers 10 pass through an embossing roller 11 and a counter cylinder 12, which form the aforementioned embossing press 9.

The above explanations relating to an embossing press 9 are valid for all exemplary embodiments according to FIGS. 2–7.

Figure 3:
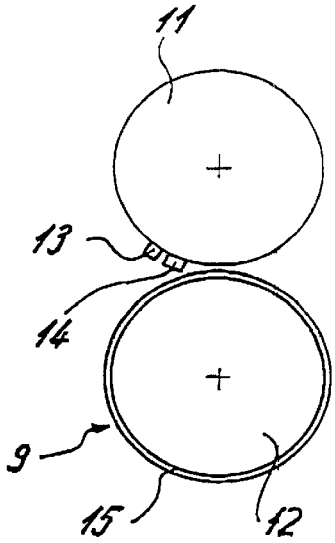
FIG. 3 Shows a schematic view from the side of the embossing press according to FIG. 2.

The special feature of the embossing press 9 according to the example shown in FIGS. 2 and 3 is that the embossing roller 11 therein is provided with two parallel rows of embossing teeth 13 and 14, arranged at a specified distance to each other, while the counter cylinder 12 is designed as a fluted roller with a plurality of ridges 15 across the periphery.

The shape of the flutes formed between ridges 15 corresponds mostly to the cross-sectional shape of the embossing teeth 13, which can dip into these flutes between ridges 15 to produce the embossed seam of the two superimposed paper layers 10.

Differing from the embodiment according to FIGS. 2 and 3, the fluted roller or counter cylinder 12 can also be provided with flutes formed between ridges 15 in the embossing region only. However, it is necessary in that case to synchronize the drive of embossing roller 11 and fluted roller or counter cylinder 12, such that during each rotation the embossing teeth 13 and 14 with certainty dip into the flutes between ridges 15 that are inserted in some areas. The advantage of this version is that only some areas of fluted roller counter cylinder 12 must be provided with ridges 15 and the associated flutes.

Figure 5:
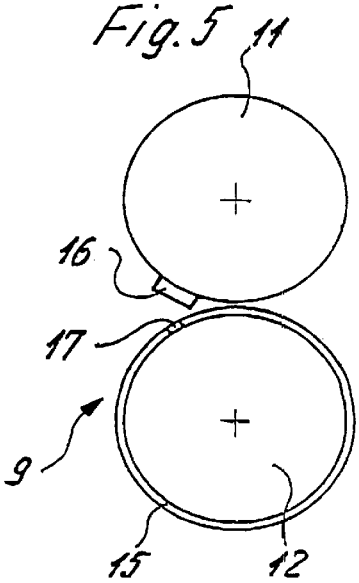
FIG. 5 Shows a view from the side of the embossing press according to FIG. 4.

FIGS. 4 and 5 show an exemplary embodiment of an embossing press 9 where the embossing roller 11 is provided with only one row of embossing teeth 16, the total width of which corresponds at least to the total width of the embossed seams that can be produced during each embossing operation. The counter cylinder 12 in the form of a fluted roller, in turn, is provided with a plurality of ridges 15, at least in the embossing region. The aforementioned ridged areas in the embossing region are interrupted by a groove 17 that corresponds to the course and shape of the desired, non-embossed separating zone 8 (see FIG. 1) between the two—or more—individual embossed seams.

The advantage of this embodiment is that the total width of the embossing teeth 16 is relatively wide. Thus, the danger that individual embossing teeth will break and fall out is practically non-existent. In addition, the individual embossed seams can have an extremely narrow design.

Figure 7:
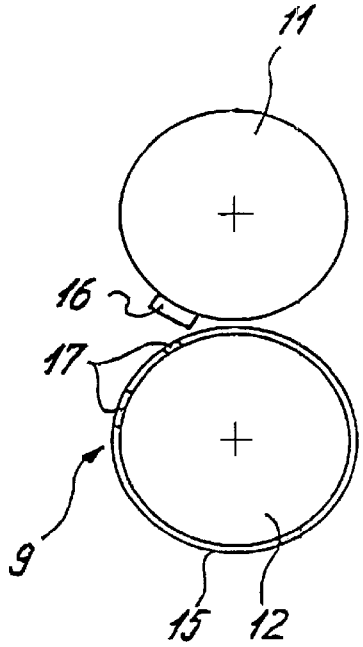
FIG. 7 Shows a view from the side of an embossing press according to FIG. 6.

FIGS. 6 and 7 show another exemplary embodiment of an embossing press 9, which extensively matches the exemplary embodiment shown in FIGS. 4 and 5. However, it deviates from the last-named embodiment in that the fluted roller or counter cylinder 12 is provided with two parallel grooves 17 of different widths.

With an embossing press 9 of this type, it is furthermore possible to achieve all the previously described advantages for the embossing press 9 according to the exemplary embodiment in FIGS. 4 and 5. In addition, an embossing press 9 according to the exemplary embodiment in FIGS. 6 and 7 makes it possible to realize different embodiments of double embossed seams using a single tool by adjusting the embossing roller 11 relative to the fluted roller 12.

If desired, it is also possible with an embossing press 9 according to the exemplary embodiment in FIGS. 6 and 7 to produce only a single embossed seams of varied width through a skillful overlapping of embossing teeth 16 on the one hand and grooves 17 on the other hand.

It will be understood that the above description of the present invention is susceptible to various modifications, changes and adaptations, and the same are intended to be comprehended within the meaning and range of equivalents of the appended claims.

What is claimed is:

1. An embossing press for producing embossed seams having a total width to join at least two paper layers or nonwoven layers, said at least two paper layers or nonwoven layers arranged one above the other and conveyed in a straight line, said embossing press comprising:

an embossing roller having a row of embossing teeth, each embossing tooth of said row of embossing teeth having a width that corresponds at least to the total width of the embossed seams produced during each embossing operation; and a counter cylinder having a rotational axis and designed as a fluted roller at least in the region of the embossing operation, said fluted roller having a plurality of ridge areas, a number of flutes formed between said ridge areas that extend across the periphery of said counter cylinder parallel to said rotational axis, and at least one groove formed across said ridged areas in the region of the embossing operation wherein the row of embossing teeth dip into the number of flutes of the fluted roller thereby producing embossed seams that extend at an angle relative to the conveying direction for the paper layers or nonwoven layers and the at least one groove is a non-embossed separating zone between individual embossed seams produced by said embossing roller and said counter cylinder.

2. An embossing press for producing embossed seams according to claim 1, wherein there are at least two grooves and two grooves of the at least two grooves have different widths.

3. An embossing press for producing embossed seams according to claim 1, wherein there is two grooves that extend parallel to each other.

4. An embossing press for producing embossed seams according to claim 2, wherein the two grooves extend parallel to each other.

5. An embossing press for producing embossed seams according to claim 1, wherein said embossing roller and said counter cylinder produce the embossed seams approximately at a right angle to the conveying direction for the paper layers or nonwoven layers.

* * * * *